United States Patent [19]

Loomie

[11] Patent Number: 5,056,247

[45] Date of Patent: Oct. 15, 1991

[54] FABRIC TENSIONING DEVICE HAVING A COLLAPSIBLE SUPPORT, ELASTIC MEANS, AND FABRIC HOOKS

[76] Inventor: Leo S. Loomie, 9 Hall Pl., Albany, N.Y. 12210

[21] Appl. No.: 534,513

[22] Filed: Jun. 6, 1990

[51] Int. Cl.[5] ..... D06C 3/08

[52] U.S. Cl. ..... 38/102.1; 38/102.3; 38/102.4; 38/102.5; 38/102.6; 38/102.8; 38/102.9; 38/102.91

[58] Field of Search .... 38/12, 64, 69, 70, 102-102.91, 38/143; 223/52, 61, 97; 69/19-19.3; 248/300-305, 441.1, 617, 684; 24/531, 533, 551

[56] References Cited

U.S. PATENT DOCUMENTS

| | | | |
|---|---|---|---|
| 632,867 | 9/1899 | Book | 38/102.5 |
| 1,326,505 | 12/1919 | Hull | 38/102.5 |
| 1,378,826 | 5/1921 | Snelling et al. | 38/102.1 |
| 2,178,153 | 10/1939 | Walker et al. | 38/102.3 |
| 2,284,004 | 5/1942 | McCurdy | 24/551 X |
| 2,494,949 | 1/1950 | Langdahl | 69/19.1 |
| 2,594,902 | 4/1952 | Frazier | 69/19.1 |
| 2,704,415 | 3/1955 | Shiffman | 38/102.8 |
| 2,810,176 | 10/1957 | Gaafar | 24/551 |
| 3,605,447 | 9/1971 | Blood et al. | 38/102.91 X |
| 3,942,272 | 3/1976 | Doyel | 38/102.5 X |
| 4,759,103 | 7/1988 | Henderson | 24/533 X |

FOREIGN PATENT DOCUMENTS

| | | | |
|---|---|---|---|
| 0232586 | 4/1925 | Belgium | 69/19.3 |
| 0472061 | 3/1951 | Canada | 38/102.7 |
| 190215 | 10/1906 | Fed. Rep. of Germany | 69/19.3 |
| 0626479 | 6/1936 | Fed. Rep. of Germany | 38/102.1 |

OTHER PUBLICATIONS

Page from Art Supply Catalogue.

*Primary Examiner*—Werner H. Schroeder
*Assistant Examiner*—Ismael Izaguirre

[57] ABSTRACT

This invention relates in general to sheet material suspension devices, and in particular to an apparatus for the suspension and tension of fabric for the purpose of hand dyeing and painting. The apparatus comprises specially designed hooks for attaching the fabric to an elastic band which in turn is attached to a lightweight, collapsible support frame. The method involves unfolding the frame so the bars are substantially equidistant at their ends, placing the elastic in notches at the ends of the bars, pulling loops of the elastic through the notches, placing the hooks on the inside of the loops, and placing the hooks into the hem of the fabric.

20 Claims, 4 Drawing Sheets

FABRIC TENSIONING DEVICE HAVING A COLLAPSIBLE SUPPORT, ELASTIC MEANS, AND FABRIC HOOKS

BACKGROUND OF THE INVENTION

1. Field Of The Invention

This invention relates in general to sheet material suspension devices, and in particular to an apparatus for the suspension and tension of fabric for the purpose of hand dyeing and painting.

2. Description of Related and Prior Art

In the field of hand dyed fabrics, free flowing dyes are applied by hand, with brushes, primarily to silk, in various original patterns. Although the dyes may be thickened, in the preferred technique, a characteristic "watercolor" look is desirable. This requires special handling of the fabric. The material must be horizontal, so the flow of the dye on the surface is regular and controllable. If the fabric to be dyed is laid loosely on a worktable, the applied dye will run along the irregularities and folds created by the loose fabric. The solution is to stretch the material taut.

In art forms such as oil painting, pigments are applied to an impermeable surface such as primed canvas, and the back of the canvas remains dry. When dye is applied to a material, the liquid permeates the fabric, so if it touches any object when wet, the dye will transfer through the fabric to the object. This produces a noticeable defect called "mark off", which spoils the design. The solution is to suspend the fabric above the work surface.

Another potential problem arises from the fact that silk for hand dyeing is generally available in the form of pre-hemmed silk scarves. It is imperative that the dyer be able to apply color all the way to the edge of the hem without any impediment to the brush from the apparatus which holds it taut and suspended. In addition, the support frame should not touch the hem of the wet fabric at any point, as the dye then will run between the fabric and the edge of the frame, again causing inappropriate "mark off".

One solution to these problems which I have attempted has been to pin the hem of the scarf to the extreme edge of a wood frame with push pins. The problem that results is that the material slackens and subsequently drops after being wetted with the dye, so the center of the scarf touches the work table, causing "mark off". The push pins as well as the frames must then be re-positioned, which is inconvienent.

Another problem with push pins is that the heads of the pins extend above the surface of the fabric, hindering the free movement of the brush as it passes over the hem. If the brush touches a push pin, the dye can accumulate at the point where the brush touches the pin, and the excess dye must be blotted quickly by the dyer to avoid spoiling the design. Another problem is that dye tends to collect on the under surface of the push pin from the wet fabric, causing "mark off", which necessitates cleaning the pin after every scarf dyed.

Another attempted solution is embodied in a frame currently in distribution which utilizes rows of upturned pins attached to bars along two opposite sides of the frame. These bars are clamped with adjustable pressure to another pair of bars without pins which form the other two sides. The bars with pins are slid along the other bars to tension the fabric. The problem here is that users have reported injury from the upturned pins and the clamp device can comes apart under tension. The fabric must be applied to the pins with a special brush, and the upturned pins leave many holes in the material. Any attachment should always be placed in the hem of the material where the resulting small perforations will not show. With this frame it is difficult to align a hemmed scarf on the many pins so that all are placed in the hem of the material. The standard brush which dyers use is made of foam, and another problem is that the upturned pins catch the brush as it passes over them.

PRIOR ART

Fabric supporting frames found in the search for prior art, such as that of Doyel U.S. Pat. No. 3,942,272, use lacings to tighten the work, which is obviously inappropriate for fine silks. Expander devices might be adapted for hand dyeing, but would be expensive to build, heavy, and difficult to ship. Other frames found in the search use various clamping devices to suspend the work. Frames of the clamp type are clearly inappropriate for this art form, as the hem of the scarf must be introduced into the clamp mechanism, and the dye cannot then penetrate to the edge of the scarf. As the dye migrates to it, the innermost edge of the clamp itself will produce "mark off".

A search in the prior art for similar attachment devices turned up Gaafar, U.S. Pat. No. 2,810,176 (Cited in Henderson U.S. Pat. No. 4,759,103), which differs substantially from the clasp hook in that the clasp end is not acicular in shape, and therefore not appropriate for use with fabrics, and also includes an additional set of bends in the intersection to act as a preventer. An extensive search revealed no prior art with regard to the hook T pin or the safety hook pin.

Various devices are known for supporting and/or stretching rugs, mats, hides and other fabric materials. These include U.S. Pat. No. 3,605,447 to Blood et al; U.S. Pat. No. 1,326,505 to Hull; U.S. Pat. No. 2,704,415 to Shiffman; and United Kingdom Appl. No. 232586 to Lhermitte. An interlocking frame is also disclosed in Canadian Pat. No. 472061 to Pridmore.

All of these devices are unusable for the hand painting of fabric for the reasons set forth below. The upward facing hooks of Blood would catch the foam brushes used to paint the fabric and the leaf springs are totally inadequate to support and take up the dye and wetted fabric. The clips to catch the hide as described in Hull and Lhermitte would cause mark off on the fabric being painted and the heavy clips such as set forth in Lhermitte would additionally cause damage to the fine fabric being hand dyed. Likewise the clips described in Shiffman would also create a mark off line on the fabric due to their design.

In addition the rope attachment means of Hull and the steel cable of Lhermitte do not provide sufficient elasticity to allow for automatic take up of the loosening dye wetted fabrics. Both Hull and Lhermitte would require manual adjustment of the attachment means during the dyeing operation.

The frame mechanism of Pridmore does not provide a plurality of interlocking members and thus requires the use of a clamp mechanism. Nor does the Pridmore frame provide the necessary vertical height to allow for the the stretching of the fabric as it is wetted to prevent the fabric from touching the work surface.

It will therefore be seen that the solution to all the problems formerly associated with this art form is embodied in the disclosed apparatus, which simultaneously suspends the scarf above the work table, stretches it taut, separates it from the edge of the frame, attaches to the hem without the attachment projecting above the surface of the work, utilizes an attachment which does not accumulate the dye or leave a multitude of holes in the material, and does not need to be repositioned due to the expansion of the wet material. In addition, the preferred embodiment is light in weight, easy to clean, folds to store or ship, has easily replacable parts, and so will maintain extended utility. The radiating bar design of the preferred embodiment allows the frame to be placed on a table smaller than the frame itself while maintaining stability, thus eliminating the need for legs.

SUMMARY OF THE INVENTION

The object of the present invention is to provide an apparatus and method for suspending and tensioning a piece of fabric for the purpose of decoration.

It is also an object of the present invention to provide an apparatus which is inexpensive to manufacture and of simple construction.

Another object is to provide such a device in lightweight form that is easily assembled for use and collapsed for shipment or storage.

A further object is to provide such a device which is safe to use, is easily cleaned, and in which the parts are both durable and easily replaced.

DETAILED DESCRIPTION OF THE PREFERRED EMBODIMENTS

Figure 1:
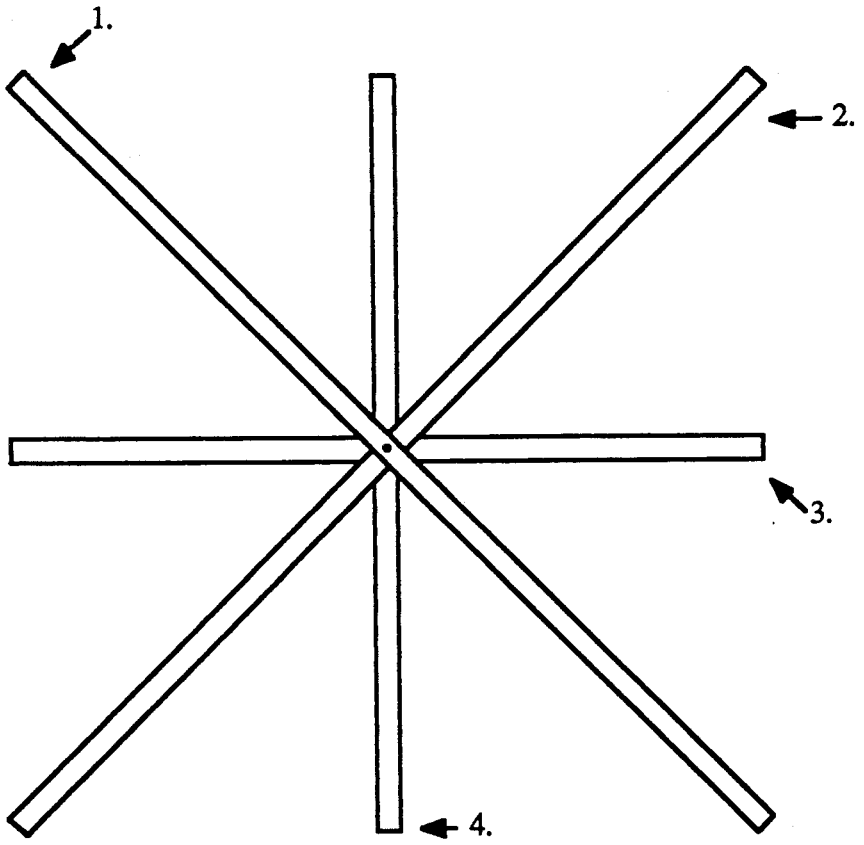
FIG. 1 is a plan view of the preferred embodiment.

Refer now to FIG. 1 which is a plan view of the apparatus, which comprises a support means of four support bars illustrated as 1, 2, 3, and 4. The bars 1, 2, are arranged at ninety degrees to each other, and bars 3, and 4, are arranged at forty-five degrees to 1, and 2. In this position, the ends of the bars are substantially equidistant from each other.

Figure 2:
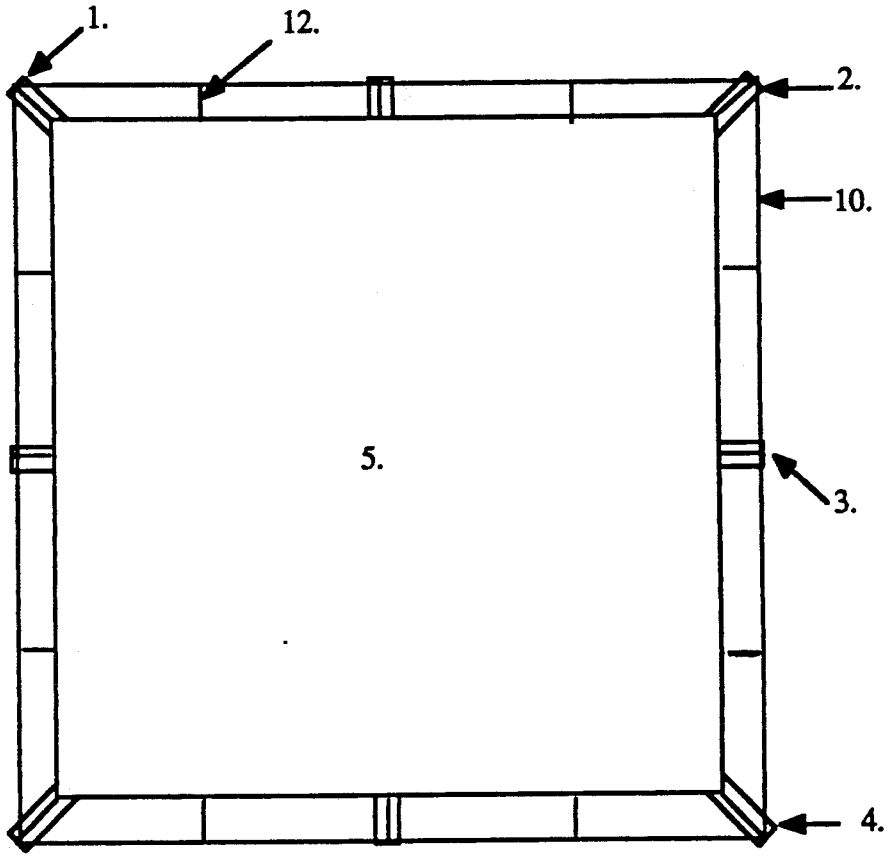
FIG. 2 is a plan view of the assembled apparatus with a piece of fabric suspended for decoration by hooked pins to an elastic loop, which is attached to a support frame.
Figure 11:
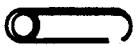
FIG. 11 shows the safety hook pin.

FIG. 2 is a plan view of the frame of FIG. 1, showing the support frame of bars 1, 2, 3, 4 attached to the elastic means here shown as a cincture or loop, 10, at their respective ends. The elastic loop, 10, is attached to the scarf, 25, by an attachment means, here shown as a plurality of attachment hooks, 12, either hooked T pins shown in FIG. 8, clasp pins shown in FIGS. 9 and 10, or hook safety pins as shown in FIG. 11. The pins 12, shown in FIG. 2, shown here totalling 16 in number, but which may be of a greater or lesser number according to the size of the apparatus employed and the number of support bars, are placed in the elastic at the terminus of manually formed loops of the elastic, such loops formed by pulling sections of the elastic through notches, 9, in the corners of the bars, and the pins subsequently attached to the elastic loop, 10, at points intermedially between the ends of the bars 1, 2, 3, 4, to provide additional support.

Figure 3:
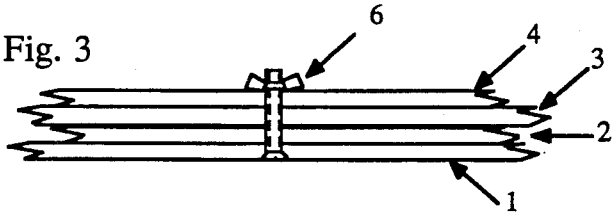
FIG. 3 is an elevation showing detail of the intermedial attachment, with machine screw and wing nut.

FIG. 3 is an elevation of the intermedial attachment of the bars 1, 2, 3, 4. Bars 1, 2, 3 and 4, are joined at their centers with a flat head machine screw, 5, and wing nut, 6. Bar, 1, is countersunk to receive the machine screw, 5.

Figure 4:
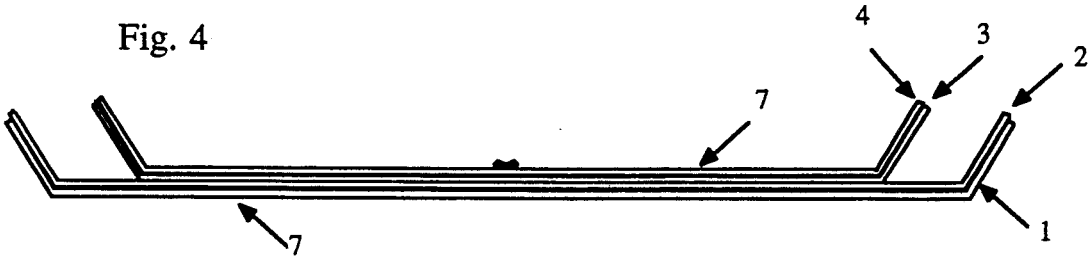
FIG. 4 is an elevation showing the apparatus folded for shipping or storage.

FIG. 4 shows the frame folded flat ready to store or ship. The Bars 1, 2, 3, 4, are bent downwards approximately five degrees at points 7, and bent upwards approximately ninety degrees at points 8. The function of the bends at 7, are to counteract the inward force exerted by the scarf, 25. A frame with the bars bent in this manner positions the outer ends of the bars in contact with the work table and therefore maintains stability under tension. The function of the bends at 8, are to elevate the fabric off the table, while not allowing the elastic to slip out of the notches into the center of the frame.

Figure 5:
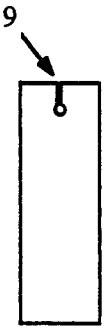
FIG. 5 shows a typical notch as cut in the ends of the support bars of the preferred embodiment.

FIG. 5 shows a typical notch, 9, as cut in the ends of bars 1, 2, 3, 4, in the preferred embodiment.

Figure 6:
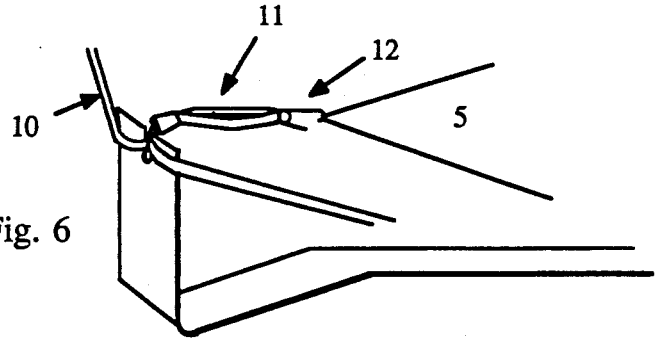
FIG. 6 is a perspective view of a typical corner of the preferred embodiment of the apparatus, showing the elastic cincture or loop attached to the corner of the fabric.
Figure 8:
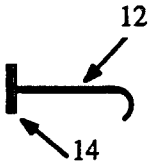
FIG. 8 shows the hooked T pin.
Figure 9:
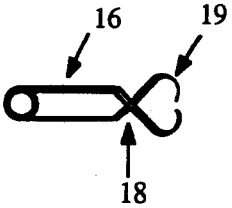
FIG. 9 shows the clasp pin in the opened position.
Figure 10:
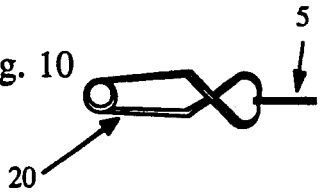
FIG. 10 shows the clasp pin in the closed position, gripping the edge of the fabric.

FIG. 6 is a perspective view of a typical frame corner of the preferred embodiment, showing the elastic, 10, pulled through a typical notch, 9, as on the ends of bars 1, 2, 3, 4. A hooked T pin, 12, as shown in FIG. 8, or clasp pin, 16, as shown in FIGS. 9 and 10, or a safety hook pin, 17, as shown in FIG. 11, is placed in the elastic, 10, at the terminus of the loop, 11, formed by pulling the elastic through the notch, 9. In the case of the hooked T pin, the T portion, 14, is on the side of the elastic facing the notch, 9, and the hook end, 15, is facing downwards and towards the center of the apparatus. In the case of the clasp pin, 16, the elastic, 10, is threaded past the wire intersection, 18, into the spring portion, 20, shown in FIG. 10. The clasp end 19, is facing the center of the apparatus. The safety hook pin, 17, is threaded onto the elastic similarly to the clasp pin, with the elastic being in the spring portion, and its hooked end placed in the hem of the material. If necessary to support a heavier material, additional hooks, 12, as shown in FIG. 2, may be placed in the elastic midway between the notched ends of bars 1,2,3,4, and hooked into the hem of the scarf, 25, directly opposite the pin's position on the elastic.

Figure 7:
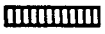
FIG. 7 shows a typical support bar section of the preferred embodiment of the apparatus.

FIG. 7 show a typical bar section of the preferred embodiment.

FIG. 8 shows the hooked T pin, 12.

FIG. 9 shows the clasp pin 16, in the open position.

FIG. 10 shows the clasp pin 16, in the closed position on the scarf, 25.

FIG. 11 shows the safety hook pin, 17.

DETAILED DESCRIPTION OF ALTERNATIVE EMBODIMENTS

Figure 12:
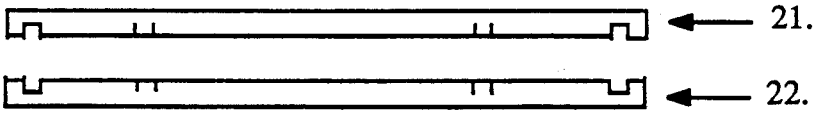
FIG. 12 shows the support members of an alternative embodiment.
Figure 13:
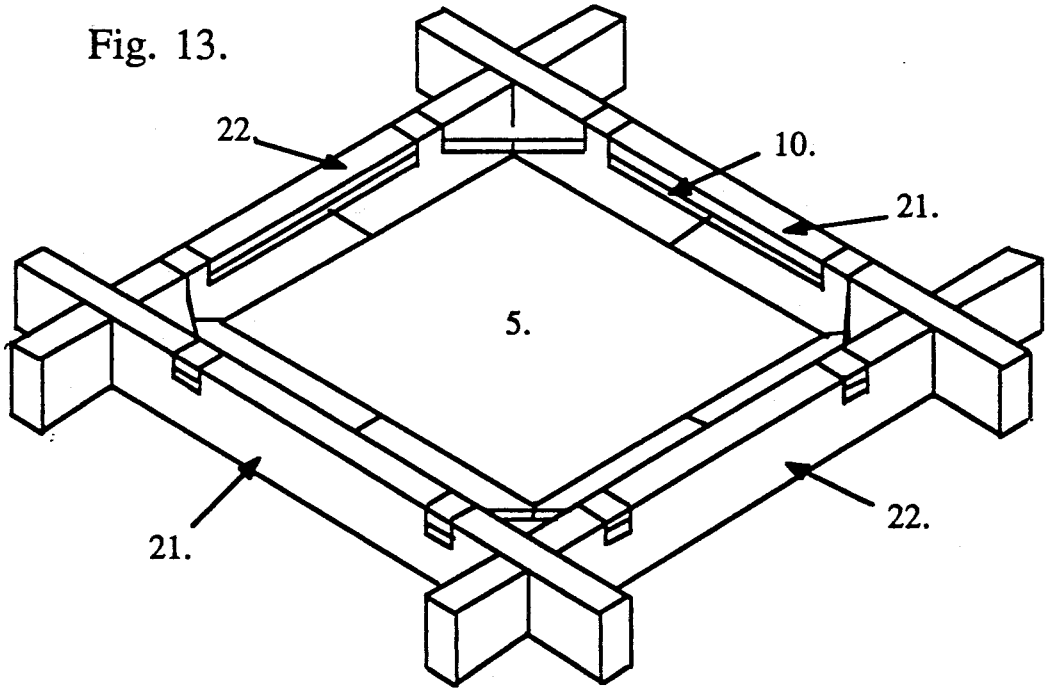
FIG. 13 shows a perspective view of an alternative embodiment, with fabric suspended for decoration.
Figure 14:
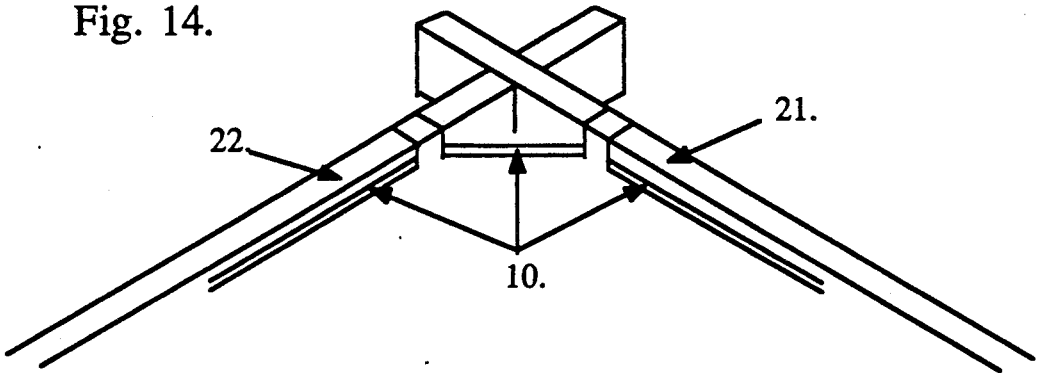
FIG. 14 is a detail of a corner of an alternative embodiment, showing the method of lacing the elastic through the notches.

Refer now to FIG. 12, which shows first an elongated member of rectangular section, 21, with notches, 27, cut on the bottom surface and pairs of slots, 28, cut on the top surface, and an second elongated member, 22, with notches, 27, and pairs of slots, 28, cut in the top surface. The frame is shown assembled in the perspective view, FIG. 13. The first pair of bars, 22, are laid on a work surface with the notches, 27, facing upwards, substantially parallel to each other. The notches, 27, on the second pair of bars, 21, are subsequently fitted frictionally into the notches, 27, of the first pair of bars, 22, so that their respective top surfaces are level. An elastic cincture, or loop, 10, is threaded around the slots, 28, and across the corners, as shown in FIG. 14, so the elastic loop, 10, will run inside the frame. Hook pins, 12, are applied to the elastic, 10, at the corners and substantially intermedially between the corners, placed into the hem of the scarf, 25, and the scarf, 25, is suspended ready to decorate.

Figure 15:
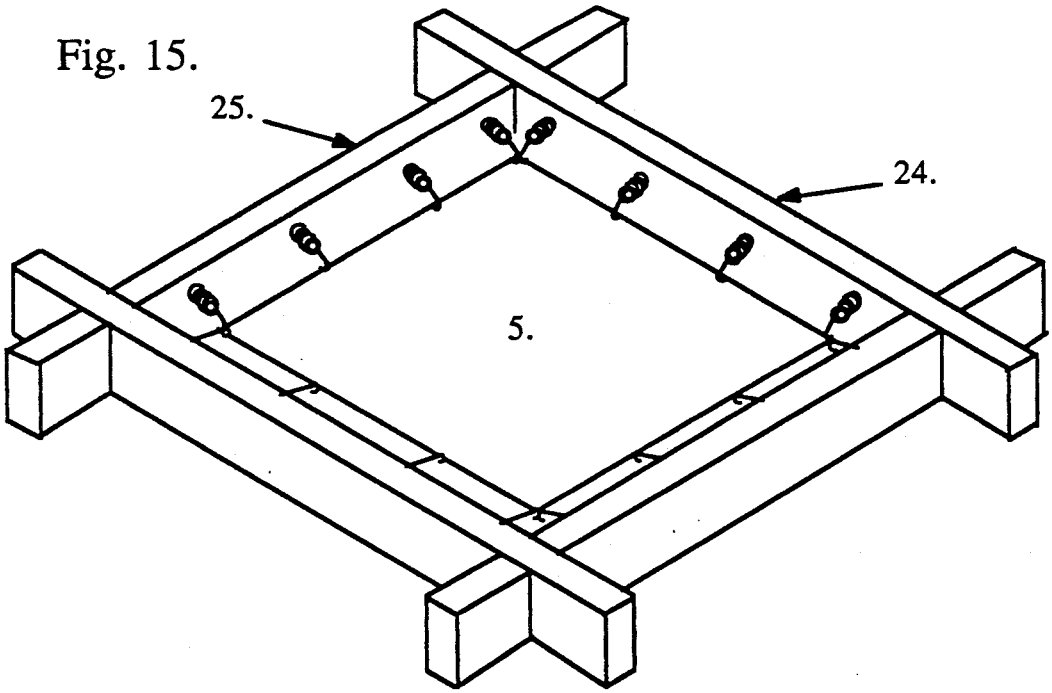
FIG. 15 is a second alternative embodiment, showing the fabric suspended by elastic hook springs.
Figure 16:
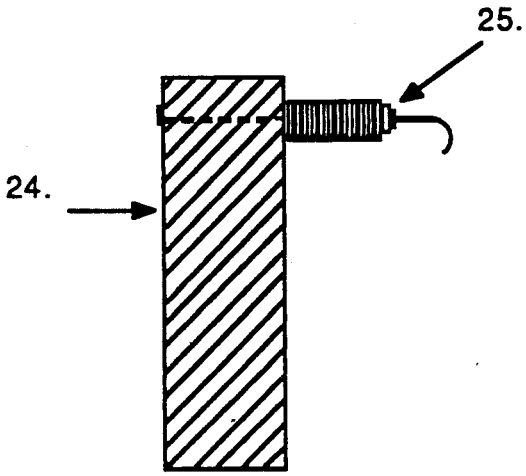
FIG. 16 is an elevation detail showing the hook spring and its attachment to the support.

Another embodiment is shown at FIG. 15, where the elastic loop, 10, and hook pins, 12, are replaced with hook springs, 26, attached to the frame, 24. FIG. 16, shows one embodiment of the hook spring, 26, attached to the frame, 24, which is shown in section.

It will therefore be seen that in the preferred embodiment, the apparatus is received by the user with the bars folded flat and attached by a machine screw and wing nut as shown in FIG. 4. An elastic loop of the appropriate length and an appropriate number of hooked pins are included. The apparatus is assembled by loosening slightly the wing nut, 6, and opening bars to the position shown in FIG. 1. The wing nut, 6, is retightened, and the elastic loop is placed around the perimeter of the frame, through the notches at the ends of the bars, and formed into loops inside the ends of the bars. The hooked T pins, safety hook pins, or clasp pins are placed in the elastic at the terminus of the loops, and then hooked into the hem of the scarf, first at the four corners, and subsequently at the notches on the bars midway between the corners. If more support is required, additional hooks may be added between the hooks already in place. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A lightweight collapsible apparatus for suspending fabric under tension above a work surface, wherein;
   said fabric is removably attached at the marginal edges of said fabric to
   a fabric attachment means removably attached to
   an elastic means removably attached to
   a pivotable foldable support means.

2. The collapsible apparatus as described in claim 1, wherein;
   said fabric attachment means comprises a plurality of hooks removably attached to
   said elastic means comprising a continuous closed elastic loop removably attached to
   said pivotable foldable support means comprising a support structure shaped and dimensioned so as to suspend said fabric above a work surface.

3. The collapsible apparatus as described in claim 1, wherein;
   said fabric attachment means comprises a plurality of hooked pins removably attached to
   said elastic means comprising a plurality of separate elastic loops removably attached to
   said pivotable foldable support means comprising a support structure shaped and dimensioned so as to suspend said fabric above a work surface.

4. The collapsible apparatus as described in claim 1, wherein;
   said fabric attachment means comprises a plurality of hooked pins removably attached to
   said elastic means comprising a continuous closed elastic loop removably attached to
   said pivotable foldable support means comprising a plurality of elongated support bars removably attached approximately centrally, shaped and dimensioned so as to suspend said fabric above a work surface.

5. The collapsible apparatus as described in claim 1, wherein;
   said fabric attachment means comprises a plurality of hooked pins removably attached to
   said elastic means comprising a continuous closed elastic loop removably attached to
   said pivotable foldable support means comprising a plurality of elongated support bars removably attached approximately centrally, shaped and dimensioned so as to suspend said fabric above a work surface,
   said elongated support bars having ends, and having voids in said ends of said elongated support bars shaped and dimensioned so as to receive said elastic loop, said elongated support bars pivotably arranged on said approximately central attachment so that said ends of said support bars are substantially equidistant from the ends of adjacent said elongated support bars.

6. The collapsible apparatus of claim 1 wherein;
   said attachment means comprise thin spring wire hooked T pins, with one end bent downward, upward and downward again to form a T shape, and one end bent downward into a hook shape with the end of said hook being of an acicular shape.

7. The collapsible apparatus of claim 1 wherein;
   said attachment means comprise thin spring wire clasp pins bent into a coil spring with two extending members, a member bent downwards at approximately forty-five degrees approximately intermedially, and bent upwards to form a hook, with the end of said hook being of an acicular shape, and a member bent upwards approximately intermedially, approximately forty-five degrees and bent downwards to form a hook, with the end of said hook being of an acicular shape, said bends formed so that said hooks form a clasp, said clasp being held springably in a closed position by said coil spring.

8. The collapsible apparatus of claim 1 wherein;

said attachment means comprise thin spring wire safety hook pins bent into a spring coil with two extending members, one member having its end bent into a hook with the end of said hook being of an acicular shape, and one member bent proximate to said coil.

9. The collapsible apparatus of claim 1 wherein;

said attachment means comprise thin spring wire hook pins, having opposed hooked ends bent into a spring coil with two extending members, one member having bent into a hook with the end of said hook being of an acicular shape, and one member bent into a hook with the end of said hook being of an acicular shape.

10. A lightweight collapsible apparatus for suspending fabric under tension above a work surface wherein;

said fabric is removably attached at the marginal edges of said fabric to a fabric attachment means removably attached to an elastic means removably attached to a support means.

11. The collapsible apparatus of claim 10 wherein;

said fabric attachment means is removably attached to a plurality of individual elastic loops removably attached to said support means.

12. The collapsible apparatus of claim 10 wherein;

said fabric attachment means comprises a plurality of thin spring wire hooked pins removably attached to a continuous closed elastic loop removably attached to said support means.

13. The collapsible apparatus of claim 12 wherein;

said fabric attachment means comprise thin spring wire hooked T pins with one end bent downward, upward and downward again to form a T shape, and one end bent downward into a hook shape with the end of said hook being of an acicular shape, removably attached to said continuous closed elastic loop removably attached to said support means.

14. The collapsible apparatus of claim 12 wherein;

said fabric attachment means comprise thin spring wire clasp pins bent into a coil spring with two extending members, a member bent downwards at approximately forty five degrees approximately intermedially, and bent upwards to form a hook, with the end of said hook being of an acicular shape, and a member bent upwards approximately intermedially, approximately forty five degrees, and bent downwards to form a hook, with the end of said hook being of an acicular shape, said bends formed so that said hooks form a clasp, said clasp being held springably in a closed position by said coil spring, removably attached to said continuous closed elastic loop removably attached to said support means.

15. The collapsible apparatus of claim 12 wherein;

said fabric attachment means comprise thin spring wire safety hook pins bent into a spring coil with two extending members, one member having its end bent into a hook with the end of said hook being of an acicular shape, and one member bent proximate to said coil, removably attached to said continuous closed elastic loop removably attached to said support means.

16. The collapsible apparatus of claim 12 wherein;

said fabric attachment means comprise thin spring wire hook pins, having opposed hooked ends bent into a spring coil with two extending members, one member bent into a hook with the end of said hook being of an acicular shape, and one member bent into a hook with the end of said hook being of an acicular shape removably attached to said continuous closed elastic loop removably attached to said support means.

17. The collapsible apparatus of claim 12 wherein;

said continuous closed elastic loop comprises a loop of sufficient strength to support said fabric, and of an appropriate length to tensionally circumscribe said support means, removably attached to said support means comprising a first pair of bars and a second pair of bars, substantially rectangular in shape, having an upper surface and a lower surface, said first pair of bars having a pair of notches cut in said upper surface, removably attached to said second pair of bars having a pair of notches cut in said lower surface of said bars, said pair of notches being shaped and dimensioned so as to be received in frictional fit with said pair of notches on said first pair of bars.

18. The collapsible apparatus of claim 12 wherein;

said fabric attachment means of a plurality of thin steel wire hooked pins removably attached to said continuous closed elastic loop of sufficient strength to support said fabric, and of an appropriate length to tensionally circumscribe said support means, removably attached to said support means comprising a first pair of bars and a second pair of bars, said bars being substantially rectangular in shape, having an upper surface and a lower surface, said first pair of bars with a pair of notches cut in said upper surface and having pairs of slots cut in said upper surface, said slots being shaped and dimensioned so as to receive said continuous closed elastic loop, removably attached to said second pair of bars having a pair of notches cut in said lower surface of said bars, said notches being shaped and dimensioned so as to be received in frictional fit with said notches on said first pair of bars, with pairs of slots cut in said upper surface of said bars, said slots being shaped and dimensioned so as to receive said continuous closed elastic loop.

19. The collapsible apparatus of claim 10 wherein;

said fabric attachment means comprise a plurality of thin spring wire hooked pins removably attached to said elastic means comprising a plurality of separate closed elastic loops of sufficient strength to support said fabric, removably attached to said support means comprising a first pair of bars and a second pair of bars, said bars being substantially rectangular in shape, said bars having an upper surface and a lower surface, said first pair of bars having a pair of notches cut in said upper surface and having pairs of slots cut in said upper surface of said bars, said slots being shaped and dimensioned so as to receive said separate closed elastic loops, removably attached to said second pair of bars, having a pair of notches cut in said lower surface of said bars, said notches being shaped and dimensioned so as to be received in frictional fit with said notches on said first pair of bars, said second pair of bars having pairs of slots cut in said upper surface of said bars, said pairs of slots being shaped and dimensioned so as to receive said separate closed elastic loops.

20. A lightweight collapsible apparatus for suspending fabric under tension above a work surface wherein;

said fabric has marginal edges and said fabric is removably attached at said marginal edges to an elastic and attachment means comprising a plurality of thin spring wire hooks, said spring wire hooks comprising a coil spring with two extending members, the first extending member having a hooked end removably attached to said marginal edges of said fabric, and the second extending member having a hooked end removably attached to a support means.

* * * * *